US011454351B2

(12) United States Patent
Guan

(10) Patent No.: US 11,454,351 B2
(45) Date of Patent: Sep. 27, 2022

(54) MULTIPHASE FLOW MIXED DELIVERY METHOD EMPLOYING RECIPROCATING DRIVING PERFORMED BY LIQUID IN TWO CHAMBERS AND DEVICE THEREOF

(71) Applicant: Guangdong Guanfu Energy Technology Pte Ltd., Guangzhou (CN)

(72) Inventor: Tianri Guan, Shandong (CN)

(73) Assignee: Guangdong Guanfu Energy Technology Pte Ltd., Guangzhou (CN)

( * ) Notice: Subject to any disclaimer, the term of this patent is extended or adjusted under 35 U.S.C. 154(b) by 0 days.

(21) Appl. No.: 17/289,876

(22) PCT Filed: Jul. 30, 2019

(86) PCT No.: PCT/CN2019/098320
§ 371 (c)(1),
(2) Date: Apr. 29, 2021

(87) PCT Pub. No.: WO2020/088012
PCT Pub. Date: May 7, 2020

(65) Prior Publication Data

US 2021/0404606 A1 Dec. 30, 2021

(30) Foreign Application Priority Data

Oct. 31, 2018 (CN) ..... 201811286148.0

(51) Int. Cl.
*F17D 1/00* (2006.01)
*F17D 3/01* (2006.01)
(Continued)

(52) U.S. Cl.
CPC ..... *F17D 1/005* (2013.01); *F17D 3/01* (2013.01); *F17D 1/14* (2013.01); *F17D 3/03* (2013.01)

(58) Field of Classification Search
CPC ... F17D 1/005; F17D 1/14; F17D 3/01; F17D 3/03
(Continued)

(56) References Cited

U.S. PATENT DOCUMENTS 2,350,061 A * 5/1944 Morgan ..... F04D 9/00 417/103
3,035,888 A * 5/1962 Massey ..... B01J 4/008 422/129
(Continued)

FOREIGN PATENT DOCUMENTS

CN 101196271 6/2008
CN 103883290 6/2014
(Continued)

OTHER PUBLICATIONS

Request for Examination dated Nov. 18, 2021 From the (ROSPATENT), Federal Government Institution of Industrial Property of the Federal Service of Intellectual Property, Patents and Trademark of the Russian Federation Re Application No. 2021114773 and Its Translation Into English. (13 Pages).
(Continued)

*Primary Examiner* — Minh Q Le

(57) ABSTRACT

A multiphase flow mixed delivery device employing reciprocating driving performed by a liquid in two chambers comprises a left container (1), a right container (2), a power pump (3), a data acquisition and control system (4), a solenoid valve group, a check valve group, an inlet manifold (5), and an outlet manifold (6). A vacuum suction chamber and a compression discharging chamber alternately formed by the two containers serve as a suction chamber and a discharging chamber of a multiphase mixed flow delivery pump. After gas in a liquid-gas mixture is separated in the container, the gas is compressed by a liquid, and is discharged out of the container. The power pump constantly
(Continued)

operates in a pure liquid working condition, thereby eliminating the issue in which a liquid with a high gas content affects the power pump. The invention requires only an ordinary water pump to achieve mixed delivery of a multiphase flow, and the ordinary water pump can even serve as a vacuum pump and a compressor for pure gas and operate continuously. Also disclosed is a multiphase flow mixed delivery method using the multiphase flow mixed delivery device employing reciprocating driving performed by a liquid in two chambers.

13 Claims, 2 Drawing Sheets

(51) Int. Cl.
*F17D 3/03* (2006.01)
*F17D 1/14* (2006.01)

(58) Field of Classification Search
USPC ..... 137/13, 2, 110, 173; 417/92, 93, 103, 417/285, 904
See application file for complete search history.

(56) References Cited

U.S. PATENT DOCUMENTS 3,273,576 A * 9/1966 Fluegel ..... G05D 21/02 210/195.1
3,416,547 A * 12/1968 Glenn, Jr. ..... G05D 7/0635 137/391
3,486,297 A * 12/1969 Simon ..... E21B 43/00 96/155
4,236,896 A * 12/1980 Morris ..... C10G 1/04 137/13
4,460,318 A * 7/1984 Horton ..... F04F 1/02 417/103
5,073,090 A * 12/1991 Cassidy ..... F04B 39/0011 417/103
5,290,151 A * 3/1994 Orlando ..... E21B 43/34 417/103
6,390,114 B1 * 5/2002 Haandrikman ..... F17D 1/005 137/187
6,652,243 B2 * 11/2003 Krasnov ..... F04F 1/06 417/103
10,774,822 B2 * 9/2020 Xiao ..... F04B 9/103
2003/0039554 A1 2/2003 Krasnov
2013/0233394 A1 * 9/2013 Nguyen ..... A61J 1/20 137/395
2016/0153447 A1 * 6/2016 Yuan ..... F04B 53/141 417/54
2018/0274730 A1 * 9/2018 Hollaender ..... F17D 3/01

FOREIGN PATENT DOCUMENTS

| | | |
|---|---|---|
| CN | 204026144 | 12/2014 |
| CN | 105890167 | 8/2016 |
| CN | 107588328 | 1/2018 |
| CN | 109114433 | 1/2019 |
| CN | 208935838 | 6/2019 |
| JP | 2000-334490 | 12/2000 |
| RU | 2128803 | 4/1999 |
| RU | 43619 | 1/2005 |
| WO | WO 2005/040670 | 5/2005 |
| WO | WO 2018/175507 | 9/2018 |

OTHER PUBLICATIONS

Request of the Substantive Examination dated Apr. 11, 2022 From the Federal Service for Intellectual Property, Federal State-Financed Institution, Federal Institute of Industrial Property of the Russian Federation, FIPS Re. Application No. 2021114773 and Its Translation Into English. (10 Pages).

* cited by examiner

MULTIPHASE FLOW MIXED DELIVERY METHOD EMPLOYING RECIPROCATING DRIVING PERFORMED BY LIQUID IN TWO CHAMBERS AND DEVICE THEREOF

RELATED APPLICATIONS

This application is a National Phase of PCT Patent Application No. PCT/CN2019/098320 having International filing date of Jul. 30, 2019, which claims the benefit of priority of Chinese Patent Application No. 201811286148.0 filed on Oct. 31, 2018. The contents of the above applications are all incorporated by reference as if fully set forth herein in their entirety.

FIELD AND BACKGROUND OF THE INVENTION

The present disclosure relates to oil and gas mixed delivery and natural gas well pressurized delivery devices in the field of oil production.

The output of crude oil is mainly a mixture of oil, water and gas, and it also contains a small amount of sediment, which is a multiphase mixture. The traditional technology of oil and gas production and delivery in oil fields is to first separate oil, gas, and water, and then use oil pumps, water pumps, and compressors to deliver them separately. There are disadvantages such as complex process flow, large investment, and difficulty in operation and maintenance.

Multiphase flow mixed delivery technology is an efficient and economical pumping technology developed in recent years, and it is the development trend of oilfield production and delivery technology at home and abroad. It uses a multiphase flow mixed delivery pump instead of a liquid pump and a gas compressor, and simultaneously deliver oil, gas, and water containing sand through a pipeline. The multiphase flow mixed delivery pump is a kind of equipment specially used for delivering crude oil mixture. Compared with the separation method, there is no need to set up special separation equipment, which saves a pipeline process, and is particularly suitable for long-distance delivery of crude oil mixtures. The development of the multiphase flow mixed delivery pump products at home is still in the initial research stage. There are mainly multiphase flow mixed delivery pumps of rotary, such as screw pumps and sliding rotor pumps. There are many technical problems that need to be studied and resolved. Multiphase flow mixed delivery pumps mainly rely on imports, which consume a lot of foreign exchange funds. Therefore, the research and development of multiphase flow mixed delivery pumps are great significance to my country's petroleum development.

At present, domestic and foreign multiphase flow mixed delivery pumps of rotary generally have the following technical problems:

1. The effect of high gas content on the multiphase flow mixed delivery pump:

Multiphase flow mixed delivery pumps of mechanical rotary type belong to clearance sealing. Liquid is needed to ensure the sealing, lubrication, and cooling of the pump chamber when delivering gas. In the state of high gas content or slug flow, the multiphase flow mixed delivery pump will form a seal due to the lack of liquid. As a result, the efficiency of the pump drops drastically and even fails to run.

2. The effect of high moisture content on the multiphase flow mixed delivery pump:

The mixing of oil, gas, and water in a multiphase flow is not uniform. In the state of high moisture content, the water will take away the lubricating oil between the friction parts in the pump chamber. Friction parts such as rotor and side plate, screw and screw sleeve, rotor bearing, etc. are more severely worn due to lack of lubricating oil, causing sintering damage in the short term.

3. Dynamic sealing problem of the multiphase flow mixed delivery pump:

The biggest sealing problem of the multiphase flow mixed delivery pump is that the shaft end and the shaft in the pump chamber are dynamically sealed. It faces a multiphase sealing problem. Not only the sealing under pure liquid or pure gas conditions, but also the sealing problems under high-speed and variable-speed conditions. The sealing problems of the multiphase flow mixed delivery pumps are an important issue in the design and research of the multiphase flow mixed delivery pumps at home and abroad.

4. The effect of load changes on the multiphase flow mixed delivery pump:

The load and rotation speed of the multiphase flow mixed delivery pumps of mechanical rotary type will change with the adjustment of the medium flow state. The high-speed rotating rotor intensifies the separation of gas and liquid, resulting in greater load changes, resulting in violent vibration and displacement of the drive shaft, or even breakage.

SUMMARY OF THE INVENTION

In view of the defects in the prior art, an object of the present disclosure is to provide a multiphase flow mixed delivery method and device employing reciprocating driving performed by a liquid in two chambers. It is used to drive a pump to always work in pure liquid working condition to realize liquid, gas or liquid and gas mixture delivery.

The principle of the present disclosure is as follows: a power pump drives liquid in a left container and a right container to reciprocate, so that the left container and the right container alternately form a vacuum suction chamber and a compression discharging chamber at an inlet and an outlet of the power pump to realize the continuous delivery of liquid, gas or liquid and gas mixture. Liquid level gauges transmit a level signal of the left container and a level signal of the right container to the data acquisition and control system. The data acquisition and control system controls a solenoid valve group or a solenoid reversing valve to turn on and turn off according to the changes in the liquid level of the left container and the liquid level of the right container, and automatically switches an inlet flow direction and an outlet flow direction of the power pump. An inlet check valve and an outlet check valve on the left and an inlet check valve and an outlet check valve of right container are automatically turned on and turned off by the pressure in the left container and the right container to realize continuous suction and discharge of the conveyed medium.

First, the present disclosure provides a technical solution for a multiphase flow mixed delivery device employing reciprocating driving performed by a liquid in two chambers, including two types of a solenoid valve group for changing direction and a solenoid reversing valve for changing direction, which are specifically as follows:

Firstly, the technical solution of the multiphase flow mixed delivery device employing reciprocating driving performed by a liquid in two chambers that uses a solenoid valve group for changing direction is as follows:

A left container, a right container, a power pump, a data acquisition and control system, a solenoid valve group, a check valve group, an inlet manifold, and an outlet manifold are provided.

An upper portion of the left container is provided with a medium inlet and a medium outlet, an upper portion of the right container is provided with a medium inlet and a medium outlet, the medium inlets are connected to the inlet manifold through an inlet check valve, and the medium outlets are connected to the outlet manifold through an outlet check valve.

An upper portion of a side wall of the left container is provided with a circulating fluid inlet, a lower portion of the side wall of the left container is provided with a circulating fluid outlet, a upper portion of a side wall of the right container is provided with a circulating fluid inlet, a lower portion of the side wall of the right container is provided with a circulating fluid outlet, each of the circulating fluid inlets is connected to an inlet solenoid valve, and each of the circulating fluid outlets is connected to an outlet solenoid valve. An inlet pipeline of the power pump is provided with branches respectively connected to the each of outlet solenoid valves of the left container and the right container, an outlet pipeline of the power pump is provided with branches respectively connected to each of the inlet solenoid valves of the left container and the right container.

The left container and the right container are installed with liquid level gauges, the liquid level gauges are connected to the data acquisition and control system through data lines, and the data acquisition and control system is connected to the each of inlet solenoid valves and the outlet solenoid valves through control lines.

Secondly, the technical solution of the multiphase flow mixed delivery device employing reciprocating driving performed by a liquid in two chambers that uses a solenoid reversing valve for changing direction is as follows:

A left container, a right container, a power pump, a data acquisition and control system, a solenoid reversing valve, a check valve group, an inlet manifold, and an outlet manifold are provided.

An upper portion of the left container is provided with a medium inlet and a medium outlet, an upper portion of the right container is provided with a medium inlet and a medium outlet, the medium inlets are connected to the inlet manifold through an inlet check valve, and the medium outlets are connected to the outlet manifold through an outlet check valve.

A side wall of the left container is provided with a circulating fluid entrance, a side wall of the right container is provided with a circulating fluid entrance, the power pump is connected to the circulating fluid entrances of the left container and the right container through the solenoid reversing valve.

The left container and the right container are installed with liquid level gauges, the liquid level gauges are connected to the data acquisition and control system through data lines, and the data acquisition and control system is connected to the solenoid reversing valve through control lines.

Further, in the reversing mode of the solenoid reversing valve: the circulating fluid entrance of the left container is connected to a port A of the solenoid reversing valve, the circulating fluid entrance of the right container is connected to a port B of the solenoid reversing valve, an inlet of the power pump is connected to a port T of the solenoid reversing valve, and an outlet of the power pump is connected to a port P of the solenoid reversing valve.

Further, in the reversing mode of the solenoid valve group and the solenoid reversing valve:

A bottom portion of the left container is provided with a sewage outlet, a bottom portion of the right container is provided with a sewage outlet, and the sewage outlets are installed with sewage valves.

Sensing ends of the liquid level gauges are respectively connected to a liquid level detection port located on the lower portion of the left container and a liquid level detection port located on the lower portion of the right container, ventilation ends of the liquid level gauges are respectively connected to the medium outlet located on the upper portion of the left container and the medium outlet located on the upper portion of the right container.

Furthermore, a liquid and gas mixed media delivery method using the multiphase flow mixed delivery device employing reciprocating driving performed by a liquid in two chambers. Similarly, it also includes two forms of a solenoid valve group for changing direction and a solenoid reversing valve for changing direction. The details are as follows:

Firstly, a liquid and gas mixed media delivery method using the multiphase flow mixed delivery device employing reciprocating driving performed by a liquid in two chambers using a solenoid valve group for changing direction comprises steps of:

(1) installing a multiphase flow mixed delivery device employing reciprocating driving performed by a liquid in two chambers on a fluid mixed delivery pipeline through an inlet manifold and an outlet manifold in series, the liquid and gas mixed media flow into a left container and a right container at the same time through the inlet manifold, the inlet check valves, and the medium inlets in turn, and gas in the left container and the right container is discharged through the medium outlets, the outlet check valves, and the outlet manifold in turn;

(2) transmitting a liquid level signal to a data acquisition and control system through a liquid level gauge and sending a control instruction according to the liquid level signal through the data acquisition and control system when a liquid level in the left container and a liquid level in the right container reach a preset top stop position, the control instruction is turning off an inlet solenoid valve on the left container and an outlet solenoid valve of the right container and turning on an outlet solenoid valve on the left container and an inlet solenoid valve on the right container;

(3) starting a power pump, wherein the liquid in the left container is discharged into the right container under an action of the power pump, and the multiphase flow mixed delivery device is in the state of suction in the left container and discharge in the right container;

(4) wherein, under a negative pressure at an inlet of the power pump, the liquid level in the left container begins to drop, a vacuum is formed in an upper portion of the left container, the inlet check valve of the left container is turned on, the outlet check valve of the left container is turned off, the liquid and gas mixed media are sucked into the left container through the medium inlet, the liquid and a gas are separated after the liquid and gas mixed media enter the left container, the gas gathers in the upper portion of the left container, and the liquid moves downward along with a liquid surface, and under a positive pressure at an outlet of the power pump, wherein the liquid level in the right container rises, the inlet check valve of the right container is turned off, the outlet check valve of the right container is turned on, and the liquid in the right container is discharged into the outlet manifold through the medium outlet;

(5) transmitting a liquid level signal to the data acquisition and control system through the liquid level gauge and sending a control instruction according to the liquid level signal through the data acquisition and control system when the liquid level in the left container drops a preset bottom stop position, the control instruction is turning off the outlet solenoid valve on the left container and the inlet solenoid valve of the right container, and turning on the inlet solenoid valve on the left container and the outlet solenoid valve on the right container;

(6) discharging the liquid in the right container into the left container under an action of the power pump, and the multiphase flow mixed delivery device is in the state of discharge in the left container and suction in the right container;

(7) wherein, under a negative pressure at the inlet of the power pump, the liquid level in the right container begins to drop, a vacuum is formed in an upper portion of the right container, the inlet check of the right container valve is turned on, the outlet check valve of the right container is turned off, the liquid and gas mixed media are sucked into the right container through the medium inlet, the liquid and the gas are separated after the liquid and gas mixed media enter the right container, the gas gathers in the upper portion of the right container, and the liquid moves downward along with the liquid surface, and under a positive pressure at the outlet of the power pump, the liquid level in the left container rises, the inlet check valve of the left container is turned off, the outlet check valve of the left container is turned on, and the gas in the upper portion of the left container is compressed by the rising liquid and discharged into the outlet manifold through the medium outlet;

(8) transmitting a liquid level signal to the data acquisition and control system through the liquid level gauge and sending a control instruction according to the liquid level signal through the data acquisition and control system when the liquid level in the right container drops to a preset bottom stop position, the control instruction is turning off the inlet solenoid valve on the left container and the outlet solenoid valve of the right container, and turning on the outlet solenoid valve on the left container and the inlet solenoid valve on the right container;

(9) discharging the liquid in the left container into the right container under an action of the power pump, and the multiphase flow mixed delivery device is in the state of suction in the left container and discharge in the right container; and

(10) repeating the above steps, wherein liquid in the left container and the right container is reciprocally and the left container and the right container alternately suck and discharge liquid to realize a mixed delivery of the liquid and the gas.

Secondly, a liquid and gas mixed media delivery method using the multiphase flow mixed delivery device employing reciprocating driving performed by a liquid in two chambers using a solenoid reversing valve for changing direction is provided. The steps thereof are the same as said method that uses the solenoid valve group to change directions, but only a solenoid reversing valve is used to replace the inlet solenoid valves and the outlet solenoid valves to realize a function of switching inlet and outlet flow directions of the power pump.

Lastly, a gas medium delivery method using the multiphase flow mixed delivery device employing reciprocating driving performed by a liquid in two chambers using a solenoid reversing valve for changing direction is provided. Similarly, there are two types of devices for changing flow directions: a solenoid valve group for changing direction and a solenoid reversing valve for changing direction, which are specifically as follows:

Firstly, a gas medium delivery method using the multiphase flow mixed delivery device employing reciprocating driving performed by a liquid in two chambers using a solenoid valve group for changing direction comprises steps of:

(1) installing an inlet manifold and an outlet manifold of a multiphase flow mixed delivery device employing reciprocating driving performed by a liquid in two chambers on a gas delivery pipeline, wherein a left container is filled with the circulating fluid in advance and a circulating fluid level in a right container is controlled to be at a preset bottom stop position;

(2) sending a control instruction through a data acquisition and control system, the control instruction is turning off an inlet solenoid valve on the left container and an outlet solenoid valve of the right container and turning on an outlet solenoid valve on the left container and an inlet solenoid valve on the right container;

(3) starting a power pump, wherein liquid in the left container is discharged into the right container under an action of the power pump, and the multiphase flow mixed delivery device is in the state of vacuum suction in the left container and compression and discharge in the right container;

(4) wherein, under a negative pressure at an inlet of the power pump, wherein the liquid level in the left container begins to drop, a vacuum is formed in an upper portion of the left container, the inlet check valve of the left container is turned on, the outlet check valve of the left container is turned off, the gas medium is sucked into the left container through the medium inlet, and under a positive pressure at an outlet of the power pump, wherein the liquid level in the right container rises, the inlet check valve of the right container is turned off, the outlet check valve of the right container is turned on, and the gas medium in the right container is compressed by rising liquid and discharged into the outlet manifold through the medium outlet;

(5) compressing the gas medium on an upper portion of the right container by the liquid surface to discharge all when the liquid level in the right container reaches a preset top stop position, and filling inhaled gas medium in the upper portion of the left container when the liquid level in the left container reaches the preset bottom stop position at the same time, wherein the liquid level gauge transmits a liquid level signal to a data acquisition and control system and the data acquisition and control system sends control instruction according to the liquid level signal, the control instruction is turning off the outlet solenoid valve on the left container and the inlet solenoid valve of the right container, and turning on the inlet solenoid valve on the left container and the outlet solenoid valve on the right container;

(6) discharging liquid in the right container into the left container under an action of the power pump, and the multiphase flow mixed delivery device is in the state of compression and discharge in the left container and vacuum suction in the right container;

(7) wherein, under a negative pressure at the inlet of the power pump, wherein the liquid level in the right container begins to drop, a vacuum is formed in an upper portion of the right container, the inlet check valve of the right container is turned on, the outlet check valve of the right container is turned off, the gas medium is sucked into the right container through the medium inlet to gather in the upper portion of the right container, and under a positive pressure at the outlet of the power pump, the liquid level in the left container rises, the inlet check valve of the left container is turned off, the outlet check valve of the left container is turned on, and the gas medium in the upper portion of the left container is compressed by rising liquid and discharged into the outlet manifold through the medium outlet;

(8) compressing the gas medium in the upper portion of the left container by the liquid surface to discharge all when the liquid level in the left container reaches a preset top stop position, and filling inhaled gas medium in the upper portion of the right container when the liquid level in the right container reaches the preset bottom stop position at the same time, wherein the liquid level gauge transmits a liquid level signal to the data acquisition and control system and the data acquisition and control system sends control instruction according to the liquid level signal, the control instruction is turning off the inlet solenoid valve on the left container and the outlet solenoid valve of the right container, and turning on the outlet solenoid valve on the left container and the inlet solenoid valve on the right container;

(9) discharging the liquid in the left container into the right container under an action of the power pump, and the multiphase flow mixed delivery device is in the state of vacuum suction in the left container and compression and discharge in the right container;

(10) repeating the above steps, wherein liquid in the left container and the right container is reciprocally and the left container and the right container alternately suck and discharge liquid to realize continuous delivery of gas medium.

Secondly, a gas medium delivery method using the multiphase flow mixed delivery device employing reciprocating driving performed by a liquid in two chambers using a solenoid reversing valve for changing direction is provided. The steps are the same as said method of the solenoid valve group, but only a solenoid reversing valve is used to replace inlet solenoid valves and outlet solenoid valves to realize a function of switching inlet and outlet flow directions of the power pump.

Compared with the prior art, the present disclosure has the following advantages:

(1) The vacuum suction chamber and the compression discharging chamber that are formed alternately by the two containers are used as the suction chamber and discharge chamber of the multiphase flow mixed delivery pump. After the gas in the liquid and gas mixed media is separated in the chamber, the gas is compressed and discharged out of the chamber by the liquid. The power pump always works in pure liquid condition, which eliminates the problem of high gas content to the pump. The mixed delivery of multiphase flow can be realized by using ordinary water pumps and can even be used as a vacuum pump and compressor for pure gas to operate continuously. It provides new technical methods and research directions for the field of multiphase flow mixed delivery technology.

(2) The structural principle is simple, wherein the rising and falling liquid levels in the two containers act as a power piston, and there are no mechanical seal and lubrication problems. The liquid levels can be driven by an ordinary water pump. It does not have a complex structure as a multiphase flow mixed delivery pump of mechanical rotary type, and solves the problem of high water content to the pump.

(3) The driving pump always works in pure liquid condition, and therefore ordinary mechanical seals can be used, which solves the multiphase sealing problem of multiphase flow mixed delivery pumps.

(4) The driving pump always works in pure liquid condition, and there are no load changes caused by the change of the medium flow state.

In the figures: 1. left container, 1-1, first circulating fluid inlet, 1-2, first circulating fluid outlet, 1-3, first medium inlet, 1-4, first medium outlet, 1-5, first liquid level detection port, 1-6, first sewage outlet, 1-7, first inlet solenoid valve, 1-8, first outlet solenoid valve, 1-9, first inlet check valve, 1-10, first outlet check valve, 1-11, first sewage valve, 1-12, first liquid level gauge, 1-13, first connecting pipe, 1-14, first circulating fluid entrance, 2, right container, 2-1, second circulating fluid inlet, 2-2, second circulating fluid outlet, 2-3, second medium inlet, 2-4, second medium outlet, 2-5, second liquid level detection port, 2-6, second sewage outlet, 2-7, second inlet solenoid valve, 2-8, second outlet solenoid valve, 2-9, second inlet check valve, 2-10, second outlet check valve, 2-11, second sewage valve, 2-12, second liquid level gauge, 2-13, second connecting pipe, 2-14, second circulating fluid entrance, 3, power pump, 4, data acquisition and control system, 5, inlet manifold, 6, outlet manifold, 7, solenoid reversing valve.

DESCRIPTION OF SPECIFIC EMBODIMENTS OF THE INVENTION

Embodiment 1

Figure 1:
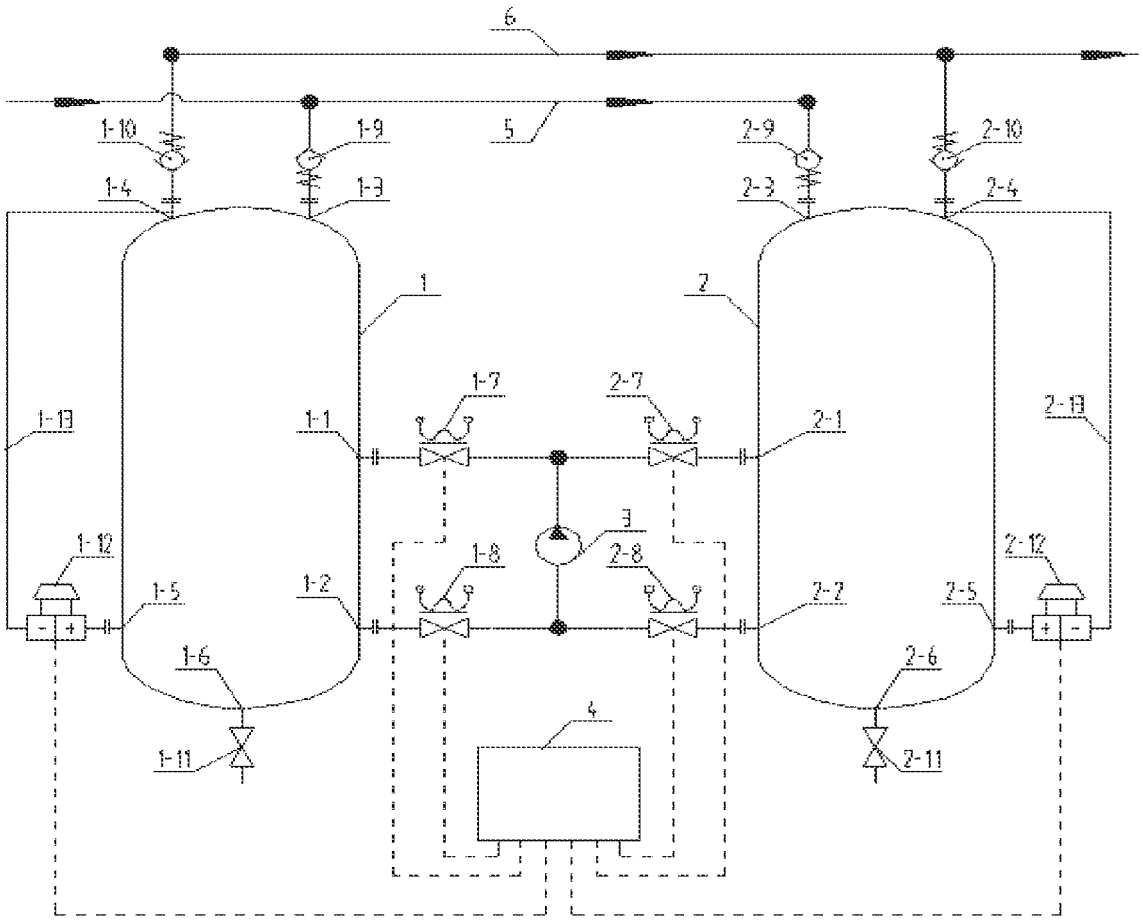
FIG. 1 is a schematic structural diagram of a multiphase flow mixed delivery device employing reciprocating driving performed by a liquid in two chambers according to Embodiment 1 of the present disclosure.
Figure 2:
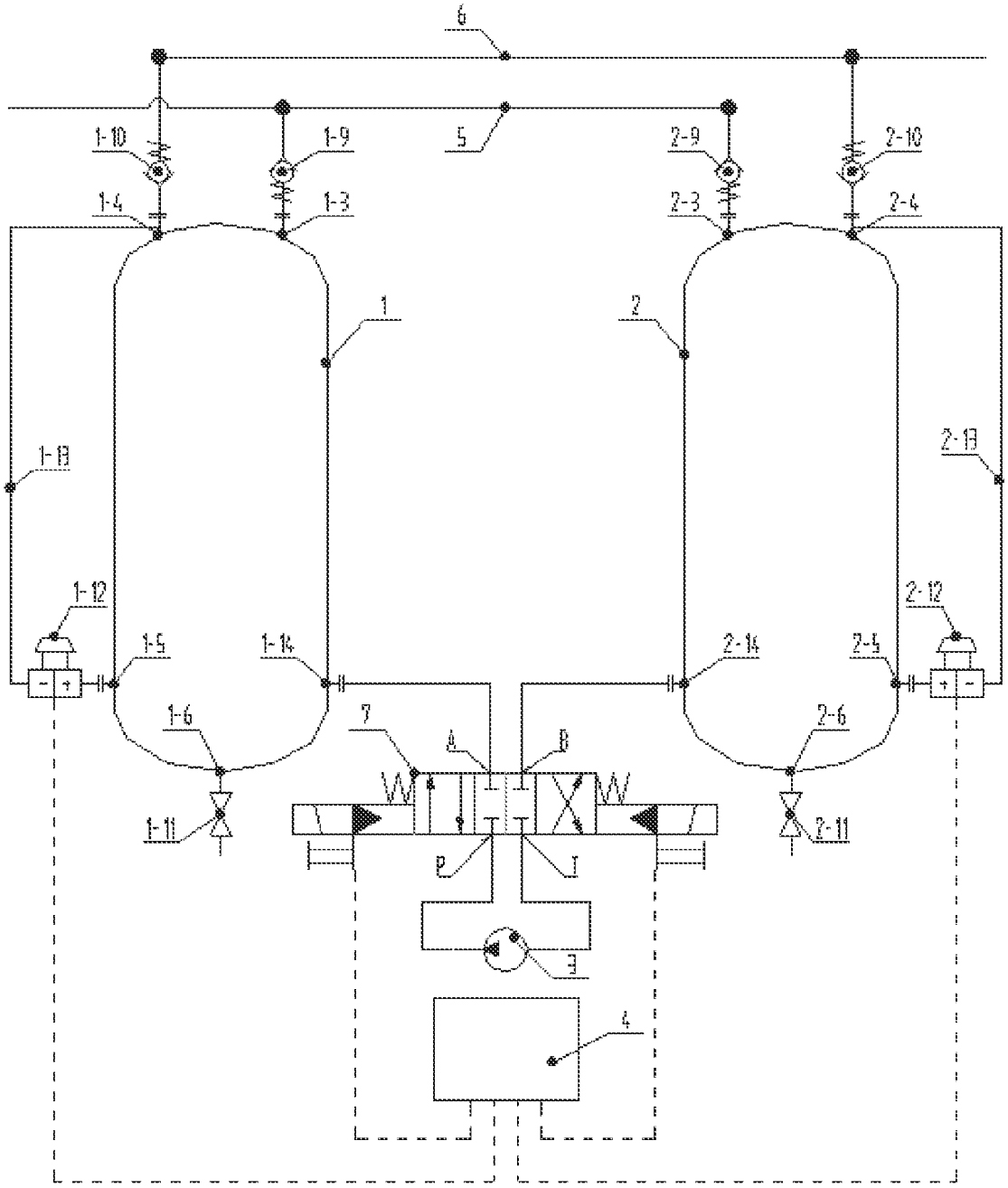
FIG. 2 is a schematic structural diagram of a multiphase flow mixed delivery device employing reciprocating driving performed by a liquid in two chambers according to Embodiment 2 of the present disclosure.

Refer to FIG. 1, a multiphase flow mixed delivery device employing reciprocating driving performed by a liquid in two chambers comprises a left container 1, a right container 2, a power pump 3, a data acquisition and control system 4, a solenoid valve group, a check valve group, an inlet manifold 5, and an outlet manifold 6.

An upper portion of the left container 1 is provided with a medium inlet and a medium outlet, an upper portion of the right container 2 is provided with a medium inlet and a medium outlet, which are a first medium inlet 1-3, a second medium inlet 2-3, a first medium outlet 1-4, and a second medium outlet 2-4. The first medium inlet 1-3 and the second medium inlet 2-3 are connected to the inlet manifold 5 through a first inlet check valve 1-9 and a second inlet check valve 2-9. The first medium outlet 1-4 and the second medium outlet 2-4 are connected to the outlet manifold 6 through a first outlet check valve 1-10 and a second outlet check valve 2-10.

An upper portion of a side wall of the left container 1 is provided with a circulating fluid inlet, a lower portion of the side wall of the left container 1 is provided with a circulating fluid outlet, a upper portion of a side wall of the right container 2 is provided with a circulating fluid inlet, a lower portion of the side wall of the right container 2 is provided with a circulating fluid outlet, which are a first circulating fluid inlet 1-1, a second circulating fluid inlet 2-1, a first circulating fluid outlet 1-2, and a second circulating fluid outlet 2-2. The first circulating fluid inlet 1-1 is connected to a first inlet solenoid valve 1-7, the first circulating fluid outlet 1-2 is connected to a first outlet solenoid valve 1-8, the second circulating fluid inlet 2-1 is connected to a second inlet solenoid valve 2-7, and the second circulating fluid outlet 2-2 is connected to a second outlet solenoid valve 2-8.

An inlet pipeline of the power pump 3 is provided with branches respectively connected to the first outlet solenoid valve 1-8 of the left container 1 and the second outlet solenoid valve of the right container 2. An outlet pipeline of the power pump 3 is provided with branches respectively connected to the first inlet solenoid valve 1-7 of the left container 1 and the second inlet solenoid valve 2-7 of the right container 2.

The left container 1 is installed with a first liquid level gauge 1-12, and the right container 2 is installed with a second liquid level gauge 2-12. The first liquid level gauge 1-12 and the second liquid level gauge 2-12 are connected to the data acquisition and control system 4 through data lines, and the data acquisition and control system 4 is connected to the first inlet solenoid valve 1-7, the second inlet solenoid valve 2-7, the first outlet solenoid valve 1-8, and the second outlet solenoid valve 2-8 through four control lines. That is, the data acquisition and control system 4 controls each of the solenoid valves for turning on or turning off through the four control lines.

Said multiphase flow mixed delivery device employing reciprocating driving performed by a liquid in two chambers includes two working states, namely a multiphase flow mixed delivery state of the liquid and gas mixed media and a pure gas medium delivery state. The working processes are as follows:

1. Multiphase Flow Mixed Delivery State of the Liquid and Gas Mixed Media (Mixed Delivery Pump Function):

Refer to FIG. 1, installing the inlet manifold 5 and the outlet manifold 6 of the multiphase flow mixed delivery device employing reciprocating driving performed by a liquid in two chambers on a fluid mixed delivery pipeline in series. The liquid and gas mixed media flow into the left container 1 and the right container 6 at the same time through the inlet manifold 5, the inlet check valves (the first inlet check valve 1-9 and the second inlet check valve 2-9), and medium inlets (the first medium inlet 1-3 and the second medium inlet 2-3) in turn, and gas in the left container 1 and the right container 2 is discharged through medium outlets (the first medium outlet 1-4 and the second medium outlet 2-4), outlet check valves (the first outlet check valve 1-10 and the second outlet check valve 2-10), and the outlet manifold 6 in turn.

The first liquid level gauge 1-12 and the second liquid level gauge 2-12 transmit liquid level signals to the data acquisition and control system 4 and the data acquisition and control system 4 sends a control instruction according to the liquid level signals when a liquid level in the left container 1 and a liquid level in the right container 2 reach a preset top stop position (the upper portion of the container body). The control instruction is turning on the first outlet solenoid valve 1-8 and the second inlet solenoid valve 2-7, turning off the first inlet solenoid valve 1-7 and the second outlet solenoid valve 2-8, and starting a power pump 3. The liquid in the left container 1 is discharged into the right container 2 through the first circulating fluid outlet 1-2, the first outlet solenoid valve 1-8, the power pump 3, the second inlet solenoid valve 2-7, and the second circulating fluid inlet 2-1 under an action of the power pump 3. The multiphase flow mixed delivery device is in the state of suction in the left container 1 and discharge in the right container 2. Under a negative pressure at an inlet of the power pump 3, the liquid level in the left container 1 begins to drop. A vacuum is formed in an upper portion of the left container 1, the first inlet check valve 1-9 is turned on, and the first outlet check valve 1-10 is turned off. The liquid and gas mixed media are sucked into the left container 1 through the first medium inlet 1-3. The liquid and the gas are separated after the liquid and gas mixed media enter the left container 1, the gas gathers in the upper portion of the left container 1, and the liquid moves downward along with a liquid surface. Under a positive pressure at the outlet of the power pump 3, the liquid level in the right container 2 rises. The second inlet check valve 2-9 is turned off, and the second outlet check valve 2-10 is turned on. The liquid in the right container 2 is discharged into the outlet manifold 6 through the second medium outlet 2-4.

The first liquid level gauge 1-12 and the second liquid level gauge 2-12 transmit liquid level signals to the data acquisition and control system 4 and the data acquisition and control system 4 sends a control instruction according to the liquid level signals when the liquid level in the left container 1 drops a preset bottom stop position (a half of the container body). The control instruction is turning on the first inlet solenoid valve 1-7 and the second outlet solenoid valve 2-8, turning off the first outlet solenoid valve 1-8 and the second inlet solenoid valve 2-7. The liquid in the right container 2 is discharged into the left container 1 through the second circulating fluid outlet 2-2, the second outlet solenoid valve 2-8, the power pump 3, the first inlet solenoid valve 1-7, and the first circulating fluid inlet 1-1 under an action of the power pump 3. The multiphase flow mixed delivery device is in the state of discharge in the left container 1 and suction in the right container 2. Under a negative pressure at the inlet of the power pump 3, the liquid level in the right container 2 begins to drop. A vacuum is formed in an upper portion of the right container 2. The second inlet check valve 2-9 is turned on, the second outlet check valve 2-10 is turned off, and the liquid and gas mixed media are sucked into the right container 2 through the second medium inlet 2-3. The liquid and the gas are separated after the liquid and gas mixed media enter the right container 2. The gas gathers in the upper portion of the right container 2, and the liquid moves downward along with the liquid surface. Under a positive pressure at the outlet of the power pump 3, the liquid level in the left container 1 rises. The first inlet check valve 1-9 is turned off, the first outlet check valve 1-10 is turned on, and the gas and the liquid in the left container 1 are discharged into the outlet manifold 6 through the first medium outlet 1-4.

The second liquid level gauge 2-12 transmits the liquid level signal to a data acquisition 4 when the liquid level in the right container 2 drops to the preset bottom stop position. The data acquisition and control system 4 sends control instruction according to the liquid level signal. The control instruction is turning on the first outlet solenoid valve 1-8 and the second inlet solenoid valve 2-7, turning off the first inlet solenoid valve 1-7 and the second outlet solenoid valve 2-8. The liquid in the left container 1 is discharged into the right container 2 through the first circulating fluid outlet 1-2, the first outlet solenoid valve 1-8, the power pump 3, the second inlet solenoid valve 2-7, and the second circulating fluid inlet 2-1 under an action of the power pump 3. The multiphase flow mixed delivery device is in the state of suction in the left container 1 and discharge in the right container 2. The above steps are repeated, wherein liquid in the left container and the right container is reciprocally and the left container and the right container alternately suck and discharge liquid to realize a mixed delivery of the liquid and the gas.

2. Pure Gas Delivery State: (Vacuum Pump and Compressor Function):

Refer to FIG. 1, an inlet manifold 5 of the outlet manifold of a multiphase flow mixed delivery device employing reciprocating driving performed by a liquid in two chambers is installed on a gas delivery pipeline in series. The left container 1 is filled with the circulating fluid in advance and a circulating fluid level in the right container is controlled to be at a preset bottom stop position.

A control instruction is sent through the data acquisition and control system 4. The control instruction is turning on the first outlet solenoid valve 1-8 and the second inlet solenoid valve 2-7, turning off the first inlet solenoid valve 1-7 and the second outlet solenoid valve 2-8, and starting the power pump 3. The liquid in the left container 1 is discharged into the right container 2 through the first circulating fluid outlet 1-2, the first outlet solenoid valve 1-8, the power pump 3, the second inlet solenoid valve 2-7, and the second circulating fluid inlet 2-1 under an action of the power pump 3. The multiphase flow mixed delivery device is in the state of vacuum suction in the left container 1 and compression and discharge in the right container 2. Under a negative pressure at an inlet of the power pump 3, wherein the liquid level in the left container 1 begins to drop, a vacuum is formed in an upper portion of the left container 1. The first inlet check valve 1-9 is turned on, the first outlet check valve 1-10 is turned off. The gas medium is sucked into the left container 1 through the first medium inlet 1-3. Under a positive pressure at an outlet of the power pump 3, the liquid level in the right container 2 rises, the second inlet check valve 2-9 is turned off, the second outlet check valve 2-10 is turned on. The gas medium in the right container 2 is compressed by rising liquid and discharged into the outlet manifold 6 through the second medium outlet 2-4.

The gas medium on an upper portion of the right container 2 is compressed by the liquid surface to discharge all when the liquid level in the right container 2 reaches a preset top stop position. The inhaled gas medium is filled in the upper portion of the left container 1 when the liquid level in the left container 1 reaches the preset bottom stop position at the same time. The second liquid level gauge 2-12 transmits a liquid level signal to the data acquisition and control system 4. The data acquisition and control system sends a control instruction according to the liquid level signal. The control instruction is turning on the first inlet solenoid valve 1-7 and the second outlet solenoid valve 2-8, and turning off the first outlet solenoid valve 1-8 and the second inlet solenoid valve 2-7. The liquid in the right container 2 is discharged into the left container 1 through the second circulating fluid outlet 2-2, the second outlet solenoid valve 2-8, the power pump 3, the first inlet solenoid valve 1-7, and the first circulating fluid inlet 1-1 under an action of the power pump 3. The multiphase flow mixed delivery device is in the state of compression and discharge in the left container 1 and vacuum suction in the right container 2. Under a negative pressure at the inlet of the power pump 3, the liquid level in the right container 2 begins to drop, and a vacuum is formed in an upper portion of the right container 2. The second inlet check valve 2-9 is turned on, the second outlet check valve 2-10 is turned off, and the gas medium is sucked into the right container 2 through the second medium inlet 2-3 to gather in the upper portion of the right container 2. Under a positive pressure at the outlet of the power pump 3, the liquid level in the left container 1 rises. The first inlet check valve 1-9 is turned off, the first outlet check valve 1-10 is turned on, and the gas medium in the upper portion of the left container 1 is compressed by rising liquid and discharged into the outlet manifold 6 through the first medium outlet 1-4.

The gas medium in the upper portion of the left container 1 compressed by the liquid surface to discharge all when the liquid level in the left container 1 reaches a preset top stop position. The inhaled gas medium in the upper portion of the right container 2 is filled when the liquid level in the right container 2 reaches the preset bottom stop position at the same time. The first liquid level gauge 1-12 transmits a liquid level signal to the data acquisition and control system 4. The data acquisition and control system 4 sends control instruction according to the liquid level signal. The control instruction is turning on the first outlet solenoid valve 1-8 and the second inlet solenoid valve 2-7 and turning off the first inlet solenoid valve 1-7 and the second outlet solenoid valve. The liquid in the left container 1 is discharged into the right container 2 through the first circulating fluid outlet 1-2, the first outlet solenoid valve 1-8, the power pump 3, the second inlet solenoid valve 2-7, and the second circulating fluid inlet 2-1 under an action of the power pump 3. The multiphase flow mixed delivery device is in the state of vacuum suction in the left container 1 and compression and discharge in the right container 2. The above steps are repeated, wherein liquid in the left container and the right container is reciprocally and the left container and the right container alternately suck and discharge liquid to realize continuous delivery of gas medium.

Embodiment 2

Refer to FIG. 1, a multiphase flow mixed delivery device employing reciprocating driving performed by a liquid in two chambers is provided. The structure of the device is basically the same as that of the multiphase flow mixed delivery device in Embodiment 1, except that a solenoid reversing valve 7 is used to replace the solenoid valve group in embodiment 1 (i.e. the first inlet solenoid valve 1-7, the first outlet solenoid valve 1-8, the second inlet solenoid valve 2-7, and the second outlet solenoid valve 2-8) to realize a function of switching inlet and outlet flow directions of the power pump 3. Due to the use of the solenoid reversing valve 7, the four port (the first circulating fluid inlet 1-1, the first circulating fluid outlet 1-2, the second circulating fluid inlet 2-1, the second circulating fluid outlet 2-2) on the left container 1 and the right container 2 are reduced to two ports (the first circulating fluid entrance 1-14 and the second circulating fluid entrance 2-14), wherein the first circulating fluid entrance 1-14 is connected to a port A of the solenoid reversing valve 7; the second circulating fluid entrance 2-14 is connected to a port B of the solenoid reversing valve 7; an inlet of the power pump 3 is connected to a port T of the solenoid reversing valve 7, and an outlet of the power pump 3 is connected to a port P of the solenoid reversing valve 7. The working state of the multiphase flow mixed delivery device employing reciprocating driving performed by a liquid in two chambers in this embodiment is the same as that of Embodiment 1. The only difference is the conversion of a reversing unit, that is, the control of the left and right reversing of the solenoid reversing valve 7, and the automatic switching of the inlet flow direction and outlet flow direction of the power pump 3. Therefore, except for the change of the reversing mode, the main structure of the multiphase flow mixed delivery device employing reciprocating driving performed by a liquid in two chamber in this embodiment and its operating states are the same as those in Embodiment 1, and will not be repeated.

The above are only typical embodiments of the present disclosure. Those skilled in the art may use the above-explained technical solutions to modify the present disclosure or modify it into equivalent technical solutions. Therefore, any simple modification or equivalent replacement made according to the technical solution of the present disclosure shall fall within the scope of protection of the present disclosure.

What is claimed is:

1. A multiphase flow mixed delivery device employing reciprocating driving performed by a liquid in two chambers, comprising:

a left container, a right container, a power pump, a data acquisition and control system, a solenoid valve group, a check valve group, an inlet manifold, and an outlet manifold;

wherein an upper portion of the left container is provided with a medium inlet and a medium outlet, an upper portion of the right container is provided with a medium inlet and a medium outlet, the medium inlets are connected to the inlet manifold through inlet check valves, and the medium outlets are connected to the outlet manifold through outlet check valves;

wherein an upper portion of a side wall of the left container is provided with a circulating fluid inlet, a lower portion of the side wall of the left container is provided with a circulating fluid outlet, a upper portion of a side wall of the right container is provided with a circulating fluid inlet, a lower portion of the side wall of the right container is provided with a circulating fluid outlet, each of the circulating fluid inlets is connected to an inlet solenoid valve, and the each of circulating fluid outlets is connected to an outlet solenoid valve;

wherein an inlet pipeline of the power pump is provided with branches respectively connected to each of the outlet solenoid valves of the left container and the right container, an outlet pipeline of the power pump is provided with branches respectively connected to each of the inlet solenoid valves of the left container and the right container; and wherein the left container and the right container are installed with liquid level gauges, the liquid level gauges are connected to the data acquisition and control system through data lines, and the data acquisition and control system is connected to each of the inlet solenoid valves and the outlet solenoid valves through control lines.

2. The multiphase flow mixed delivery device employing reciprocating driving performed by a liquid in two chambers according to claim 1, wherein a bottom portion of the left container is provided with a sewage outlet, a bottom portion of the right container is provided with a sewage outlet, and the sewage outlets are installed with sewage valves.

3. The multiphase flow mixed delivery device employing reciprocating driving performed by a liquid in two chambers according to claim 1, wherein sensing ends of the liquid level gauges are respectively connected to a liquid level detection port located on the lower portion of the left container and a liquid level detection port located on the lower portion of the right container, ventilation ends of the liquid level gauges are respectively connected to the medium outlet located on the upper portion of the left container and the medium outlet located on the upper portion of the right container.

4. A liquid and gas mixed media delivery method using the multiphase flow mixed delivery device employing reciprocating driving performed by a liquid in two chambers according to claim 1, comprising steps of:

(a) installing a multiphase flow mixed delivery device employing reciprocating driving performed by a liquid in two chambers on a fluid mixed delivery pipeline through the inlet manifold and the outlet manifold in series, the liquid and gas mixed media flow into the left container and the right container at the same time through the inlet manifold, the inlet check valves, and the medium inlets in turn, and gas in the left container and the right container is discharged through the medium outlets, the outlet check valves, and the outlet manifold in turn;

(b) transmitting a liquid level signal to the data acquisition and control system through a liquid level gauge and sending a control instruction according to the liquid level signal through the data acquisition and control system when a liquid level in the left container and a liquid level in the right container reach a preset top stop position, the control instruction is turning off an inlet solenoid valve on the left container and an outlet solenoid valve of the right container and turning on an outlet solenoid valve on the left container and an inlet solenoid valve on the right container;

(c) starting a power pump, wherein the liquid in the left container is discharged into the right container under an action of the power pump, and the multiphase flow mixed delivery device is in the state of suction in the left container and discharge in the right container;

(d) wherein, under a negative pressure at an inlet of the power pump, the liquid level in the left container begins to drop, a vacuum is formed in an upper portion of the left container, the inlet check valve of the left container is turned on, the outlet check valve of the left container is turned off, the liquid and gas mixed media are sucked into the left container through the medium inlet, the liquid and a gas are separated after the liquid and gas mixed media enter the left container, the gas gathers in the upper portion of the left container, and the liquid moves downward along with a liquid surface, and under a positive pressure at an outlet of the power pump, wherein the liquid level in the right container rises, the inlet check valve of the right container is turned off, the outlet check valve of the right container is turned on, and the liquid in the right container is discharged into the outlet manifold through the medium outlet;

(e) transmitting a liquid level signal to the data acquisition and control system through the liquid level gauge and sending a control instruction according to the liquid level signal through the data acquisition and control system when the liquid level in the left container drops a preset bottom stop position, the control instruction is turning off the outlet solenoid valve on the left container and the inlet solenoid valve of the right container, and turning on the inlet solenoid valve on the left container and the outlet solenoid valve on the right container;

(f) discharging the liquid in the right container into the left container under an action of the power pump, and the multiphase flow mixed delivery device is in the state of discharge in the left container and suction in the right container;

(g) wherein, under a negative pressure at the inlet of the power pump, the liquid level in the right container begins to drop, a vacuum is formed in an upper portion of the right container, the inlet check of the right container valve is turned on, the outlet check valve of the right container is turned off, the liquid and gas mixed media are sucked into the right container through the medium inlet, the liquid and the gas are separated after the liquid and gas mixed media enter the right container, the gas gathers in the upper portion of the right container, and the liquid moves downward along with the liquid surface, and under a positive pressure at the outlet of the power pump, the liquid level in the left container rises, the inlet check valve of the left container is turned off, the outlet check valve of the left container is turned on, and the gas in the upper portion of the left container is compressed by the rising liquid and discharged into the outlet manifold through the medium outlet;

(h) transmitting a liquid level signal to the data acquisition and control system through the liquid level gauge and sending a control instruction according to the liquid level signal through the data acquisition and control system when the liquid level in the right container drops to a preset bottom stop position, the control instruction is turning off the inlet solenoid valve on the left container and the outlet solenoid valve of the right container, and turning on the outlet solenoid valve on the left container and the inlet solenoid valve on the right container;

(i) discharging the liquid in the left container into the right container under an action of the power pump, and the multiphase flow mixed delivery device is in the state of suction in the left container and discharge in the right container; and (j) repeating the above steps, wherein liquid in the left container and the right container is reciprocally and the left container and the right container alternately suck and discharge liquid to realize a mixed delivery of the liquid and the gas.

5. The liquid and gas mixed media delivery method using the multiphase flow mixed delivery device employing reciprocating driving performed by a liquid in two chambers according to claim 4, wherein the top stop position is located at an upper portion of a container body and the bottom stop position is located at a half of the container body.

6. A gas medium delivery method using the multiphase flow mixed delivery device employing reciprocating driving performed by a liquid in two chambers according to claim 1, comprising steps of:

(a) installing an inlet manifold of an outlet manifold of a multiphase flow mixed delivery device employing reciprocating driving performed by a liquid in two chambers on a gas delivery pipeline in series, wherein the left container is filled with the circulating fluid in advance and a circulating fluid level in the right container is controlled to be at a preset bottom stop position;

(b) sending a control instruction through the data acquisition and control system, the control instruction is turning off an inlet solenoid valve on the left container and an outlet solenoid valve of the right container and turning on an outlet solenoid valve on the left container and an inlet solenoid valve on the right container;

(c) starting a power pump, wherein the liquid in the left container is discharged into the right container under an action of the power pump, and the multiphase flow mixed delivery device is in the state of vacuum suction in the left container and compression and discharge in the right container;

(d) wherein, under a negative pressure at an inlet of the power pump, wherein the liquid level in the left container begins to drop, a vacuum is formed in an upper portion of the left container, the inlet check valve of the left container is turned on, the outlet check valve of the left container is turned off, the gas medium is sucked into the left container through the medium inlet, and under a positive pressure at an outlet of the power pump, the liquid level in the right container rises, the inlet check valve of the right container is turned off, the outlet check valve of the right container is turned on, and the gas medium in the right container is compressed by rising liquid and discharged into the outlet manifold through the medium outlet;

(e) compressing the gas on an upper portion of the right container by the liquid surface to discharge all when the liquid level in the right container reaches a preset top stop position, and filling inhaled gas medium in the upper portion of the left container when the liquid level in the left container reaches the preset bottom stop position at the same time, wherein the liquid level gauge transmits a liquid level signal to the data acquisition and control system and the data acquisition and control system sends a control instruction according to the liquid level signal, the control instruction is turning off the outlet solenoid valve on the left container and the inlet solenoid valve of the right container, and turning on the inlet solenoid valve on the left container and the outlet solenoid valve on the right container;

(f) discharging the liquid in the right container into the left container under an action of the power pump, and the multiphase flow mixed delivery device is in the state of compression and discharge in the left container and vacuum suction in the right container;

(g) wherein, under a negative pressure at the inlet of the power pump, wherein the liquid level in the right container begins to drop, a vacuum is formed in an upper portion of the right container, the inlet check valve of the right container is turned on, the outlet check valve of the right container is turned off, the gas medium is sucked into the right container through the medium inlet to gather in the upper portion of the right container, and under a positive pressure at the outlet of the power pump, the liquid level in the left container rises, the inlet check valve of the left container is turned off, the outlet check valve of the left container is turned on, and the gas medium in the upper portion of the left container is compressed by rising liquid and discharged into the outlet manifold through the medium outlet;

(h) compressing the gas medium in the upper portion of the left container by the liquid surface to discharge all when the liquid level in the left container reaches a preset top stop position, and filling inhaled gas medium in the upper portion of the right container when the liquid level in the right container reaches the preset bottom stop position at the same time, wherein the liquid level gauge transmits a liquid level signal to the data acquisition and control system and the data acquisition and control system sends control instruction according to the liquid level signal, the control instruction is turning off the inlet solenoid valve on the left container and the outlet solenoid valve of the right container, and turning on the outlet solenoid valve on the left container and the inlet solenoid valve on the right container;

(i) discharging the liquid in the left container into the right container under an action of the power pump, and the multiphase flow mixed delivery device is in the state of vacuum suction in the left container and compression and discharge in the right container;

(j) repeating the above steps, wherein liquid in the left container and the right container is reciprocally and the left container and the right container alternately suck and discharge liquid to realize continuous delivery of gas medium.

7. The liquid and gas mixed media delivery method using the gas medium delivery method using the multiphase flow mixed delivery device employing reciprocating driving performed by a liquid in two chambers according to claim 6, wherein the top stop position is located at an upper portion of a container body and the bottom stop position is located at a half of the container body.

8. A multiphase flow mixed delivery device employing reciprocating driving performed by a liquid in two chambers, comprising:

a left container, a right container, a power pump, a data acquisition and control system, a solenoid reversing valve, a check valve group, an inlet manifold, and an outlet manifold;

wherein an upper portion of the left container is provided with a medium inlet and a medium outlet, an upper portion of the right container is provided with a medium inlet and a medium outlet, the medium inlets are connected to the inlet manifold through inlet check valves, and the medium outlets are connected to the outlet manifold through outlet check valves;

wherein a side wall of the left container is provided with a circulating fluid entrance, a side wall of the right container is provided with a circulating fluid entrance, the power pump is connected to the circulating fluid entrances of the left container and the right container through the solenoid reversing valve; and wherein the left container and the right container are installed with liquid level gauges, the liquid level gauges are connected to the data acquisition and control system through data lines, and the data acquisition and control system is connected to the solenoid reversing valve through control lines;

wherein a bottom portion of the left container is provided with a sewage outlet, a bottom portion of the right container is provided with a sewage outlet, and the sewage outlets are installed with sewage valves.

9. The multiphase flow mixed delivery device employing reciprocating driving performed by a liquid in two chambers according to claim 8, wherein the circulating fluid entrance of the left container is connected to a port A of the solenoid reversing valve, the circulating fluid entrance of the right container is connected to a port B of the solenoid reversing valve, an inlet of the power pump is connected to a port T of the solenoid reversing valve, and an outlet of the power pump is connected to a port P of the solenoid reversing valve.

10. The multiphase flow mixed delivery device employing reciprocating driving performed by a liquid in two chambers according to claim 9, wherein sensing ends of the liquid level gauges are respectively connected to a liquid level detection port located on the lower portion of the left container and a liquid level detection port located on the lower portion of the right container, ventilation ends of the liquid level gauges are respectively connected to the medium outlet located on the upper portion of the left container and the medium outlet located on the upper portion of the right container.

11. A liquid and gas mixed media delivery method using the multiphase flow mixed delivery device employing reciprocating driving performed by a liquid in two chambers according to claim 8, but wherein only a solenoid reversing valve is used to replace inlet solenoid valves and outlet solenoid valves to realize a function of switching inlet and outlet flow directions of the power pump.

12. A gas medium delivery method using the multiphase flow mixed delivery device employing reciprocating driving performed by a liquid in two chambers according to claim 8 wherein but only a solenoid reversing valve is used to replace inlet solenoid valves and outlet solenoid valves to realize a function of switching inlet and outlet flow directions of the power pump.

13. The multiphase flow mixed delivery device employing reciprocating driving performed by a liquid in two chambers according to claim 8, wherein sensing ends of the liquid level gauges are respectively connected to a liquid level detection port located on the lower portion of the left container and a liquid level detection port located on the lower portion of the right container, ventilation ends of the liquid level gauges are respectively connected to the medium outlet located on the upper portion of the left container and the medium outlet located on the upper portion of the right container.

* * * * *